US005915143A

United States Patent [19]

Watanabe et al.

[11] Patent Number: 5,915,143

[45] Date of Patent: Jun. 22, 1999

[54] IMAGE FORMING APPARATUS AND METHOD FOR AUTOMATICALLY ADJUSTING TONER DENSITY IN RESPONSE TO HUMIDITY VARIATIONS

[75] Inventors: Shigeru Watanabe; Masaru Tanaka, both of Yokohama; Haruji Mizuishi, Tokyo-to; Hiroshi Yoshinaga, Ichikawa; Kenzo Tatsumi, Yokohama; Toshitaka Yamaguchi, Omiya; Takeo Suda; Ken Amemiya, both of Tokyo-to; Mayumi Ohori, Kawasaki, all of Japan

[73] Assignee: Ricoh Company, Ltd., Tokyo, Japan

[21] Appl. No.: 08/885,688

[22] Filed: Jun. 30, 1997

[30] Foreign Application Priority Data

Jul. 3, 1996 [JP] Japan ..... 8-173500
Apr. 9, 1997 [JP] Japan ..... 9-090388

[51] Int. Cl.[6] ..... G03G 15/08

[52] U.S. Cl. ..... 399/44; 399/62

[58] Field of Search ..... 399/44, 59, 62, 399/63, 138

[56] References Cited

U.S. PATENT DOCUMENTS 5,027,077 6/1991 Yanagisawa et al. ..... 324/712
5,146,274 9/1992 Hattori et al. ..... 399/44
5,311,256 5/1994 Hamamichi et al. ..... 399/44
5,365,319 11/1994 Sakemi et al. ..... 399/44

FOREIGN PATENT DOCUMENTS 61-98370 5/1986 Japan .
62-164068 7/1987 Japan .
2-179664 7/1990 Japan .
3-261980 11/1991 Japan .
4-12380 1/1992 Japan .

*Primary Examiner*—Joan Pendegrass
*Attorney, Agent, or Firm*—Cooper & Dunham LLP

[57] ABSTRACT

An image forming apparatus which is capable of adjusting toner density in response to variations of humidity. The image forming apparatus includes a toner density detector that detects the density of toner inside an image developer, a humidity detector that detects toner humidity inside the image forming apparatus, and a controller that controls a toner supplier on the basis of the toner density detected by the toner density detector and that adjusts the toner density in accordance with variations of humidity detected by the humidity detector. The humidity detector is located at a position where the humidity detector can detect humidity of air around the image developer and where the humidity detector is minimally affected by heated air.

27 Claims, 12 Drawing Sheets

START
S1
DETERMINE $V_{t/ave}$
S2
DETERMINE $dV_t$
S3
DETERMINE $dV_{t/c}$
S4
$dV_{t/c} > 0$
NO
YES
S5
$C_1 = C_1 + 1$
S6
$C_1 > 10$
YES
NO
S7
DETERMINE TONER AMOUNT
S8
PERFORM SUPPLYING TONER
A
END
S10
SET $C_1$ AND $C_2$ TO 0, $L_{td}$ TO $(L_{td} - 1)$, AND RELEASE NEAR END
A
S12
$L_{td} = 2$
YES
NO
S13
$C_1 = C_1 + 1$
S14
$C_1 = C_1 + 1$
S15
$V_{t/ave} > V_{te}$
NO
YES
S16
$C_2 = C_2 + 1$
S17
DISPLAY TONER NEAR END
S18
$V_{t/ave} > V_{te}$
NO
YES
S19
$C_2 = C_2 + 1$

IMAGE FORMING APPARATUS AND METHOD FOR AUTOMATICALLY ADJUSTING TONER DENSITY IN RESPONSE TO HUMIDITY VARIATIONS

BACKGROUND OF THE INVENTION

1. Field of the Invention

This invention relates to an image forming apparatus, and more particularly to an image forming apparatus having a function for correcting image density to maintain appropriate image density in accordance with variations of humidity in a simple and low cost structure.

This invention also relates to a method of performing the above-mentioned function.

2. Discussion of the Background

Generally, an image forming apparatus such as a copying machine, a printer, a facsimile machine, and the like includes a number of the following main functional units which are capable of cooperatively performing a series of processes for forming an image on a recording medium. An image forming unit performs an image forming process in which an electrostatic latent image is formed on a motor-driven image bearing member made of a photoconductor or the like. An image developing unit then performs an image developing process in which the electrostatic latent image formed on the image bearing member is visualized using toner. Subsequently, an image transfer unit performs an image transfer process in which the above-mentioned toner-forming image is transferred onto a recording sheet by an attractive force generated by electric charges. Then, an image fixing unit performs an image fixing process in which the toner-forming image is fixed on the recording sheet.

The image developing unit includes an image developing agent, for example, a two-component development compound composed of toner particles and carriers. During the above-mentioned series of the processes, the image developing unit performs the image processing process using the toner particles in the two-component development compound, and is filled with new toner particles by a toner supply unit which contains new toner. The image developing unit also performs a mixing operation to mix the development compound inside so as to generate and provide an electric charge to the development compound. By the electric charge provided onto toner particles, the electrostatic latent image formed on the image bearing member is developed into the visualized image through the operation of the electric charges which attract the toner particles to the electrostatic latent image.

Many background image forming apparatus include an image developing unit having various elements horizontally mounted therein. The various elements included in the image developing unit are, for example, a plurality of mixing and circulating members for mixing and circulating the two-component development compound and a transferring member for transferring the image development compound to the photoconductor from the development unit. Horizontally mounting the various elements provides an image developing unit relatively simple and, therefore, the developing unit can be manufactured in a relatively small size and at a relatively inexpensive cost.

Due to the above-mentioned size reduction of the image developing unit, many toner supply units have accordingly had a toner supply path required to be connected to the image developing unit around an end portion of the plurality of mixing and transfer members so as not to make the advantageously-reduced size of the image developing unit any larger.

In addition, during the above-mentioned series of the processes by such background image forming apparatus, the toner supply unit, particularly its supply amount, is controlled by the image forming unit which includes a toner density detecting unit and a toner density control unit. The image forming unit can recognize toner density in the image developing unit by detecting magnetic permeability of the two-component development compound with the toner density detecting unit. Then, the toner density control unit compares the value of the detected toner density with a predetermined value of reference toner density. Subsequently, the toner density control unit controls the toner supply unit in accordance with the resultant information of the comparison.

One problem with such image forming apparatus is that the electric charge on the toner particles varies when the ambient humidity varies. As a result, the image density will vary as the charge on the toner varies. More specifically, an amount of the electric charge on the toner is reduced when humidity increases so that the toner becomes less controllable and the quality of the resulting image is reduced. For example, so-called dirty-toner-spots may form on the background of the image.

Further, in a case of using a humidity sensor to overcome the above-mentioned problem, the humidity sensor may be affected by an air flow flowing in an interior of the image forming apparatus. As a result, the humidity sensor can not correctly detect humidity around the toner and, therefore, the above-mentioned problem remains unsolved.

Presently, there exists no image forming apparatus which is capable of stabilizing image density so as to avoid, for example, the dirty-toner-spot problem through correctly detecting variations of humidity while avoiding the effects of air flow flowing inside the image forming apparatus.

SUMMARY OF THE INVENTION

Accordingly, an object of the present application is to provide a novel image forming apparatus which is capable of adjusting image density in response to variations in humidity so as to maintain an appropriate image density while avoiding effects of air flow flowing inside the image forming apparatus and which is in a simple and low cost structure.

To achieve the above-mentioned objects, the image forming apparatus includes an enclosure, having air outlets, for enclosing structural elements of the image forming apparatus, an image developer for developing an image based on an electrostatic latent image formed on an image bearing surface and a toner supplier for supplying toner to the image developer. A toner density detector is provided to detect toner density inside the image developer and a humidity detector detects humidity inside the enclosure of the image forming apparatus. The humidity detector is located at a position where the humidity detector can detect humidity of air around the image developer and where the humidity detector is minimally affected by heated air. A toner density controller controls the toner supplier in response to the toner density detected by the toner density detector and adjusts the toner density in accordance with variations of humidity detected by the humidity detector.

Preferably, the humidity detector is located at a position which is inside of the image forming apparatus, over the image developer, and at an approximate center of the image developer in the longitudinal direction of the image developer.

Preferably, the above-mentioned image forming apparatus includes a reference toner density and a reference toner density adjuster. The toner density controller compares values between the toner density detected by the toner density detector and the reference toner density and controls the toner supplier in response to the result of such a comparison. The reference toner density adjuster adjusts the value of the reference toner density in accordance with variations of humidity detected by the humidity detector.

Preferably, the reference toner density adjuster adjusts the value of the reference toner density within a predetermined limit which corresponds to a variation range of humidity in which an output value of the humidity detector has an approximate linear relationship with a value of humidity.

Further, the reference toner density adjuster adjusts a value of the reference toner density to a value higher than a value to which the reference toner density would normally be adjusted, when humidity is relatively high.

Further, in the above-mentioned image forming apparatus, the reference toner density adjuster adjusts a value of the reference toner density in response to variations of humidity detected by the humidity detector, so that a relationship between variations of humidity and the reference toner density forms an S-shaped line.

Further, the above-mentioned reference toner density adjuster includes a plurality of toner-humidity correction tables, each table containing information representing data of appropriate toner density values associated with various humidity levels, and adjusts the reference toner density in accordance with variations of humidity detected by the humidity detector, by selectively using the plurality of toner-humidity correction tables. The above-mentioned image forming apparatus further includes a table selector for selecting an appropriate table from among the plurality of toner-humidity correction tables in accordance with variations of humidity detected by the humidity detector.

Further, in the above-mentioned image forming apparatus, the reference toner density adjuster adjusts a value of the reference toner density with a variation larger than a variation with which the reference toner density would normally be adjusted, when humidity is relatively low.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
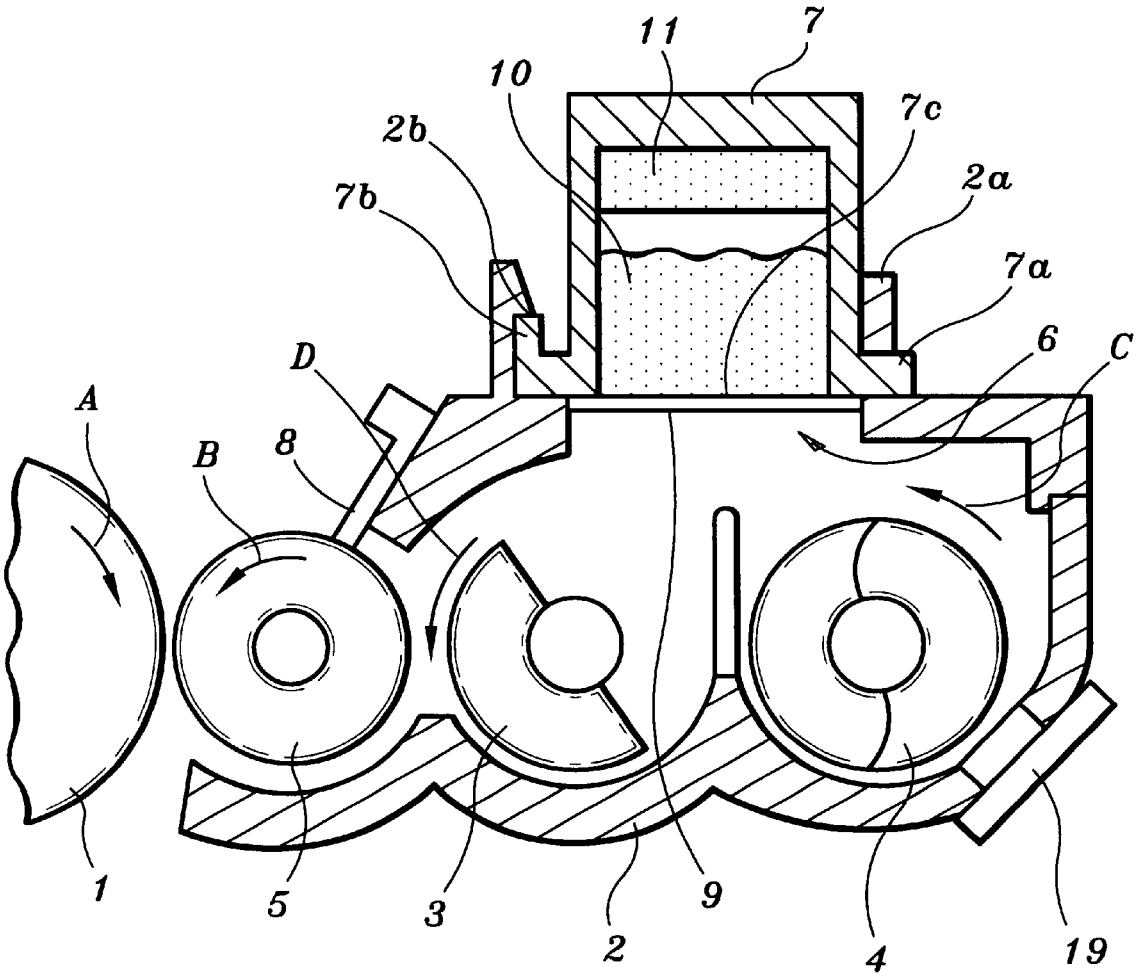
FIG. 1 is a sectional view of an exemplary image developing unit of the image forming apparatus according to the present application.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, in which a sectional view of a development unit 2 of an image forming apparatus according to the present application is shown. In FIG. 1, a drum-shaped photoreceptor 1 for forming an electrostatic latent image thereon rotates in the direction indicated by an arrow A when forming an image.

A development unit 2, covered by a casing and having a predetermined length in a direction perpendicular to the drawing in accordance with a length of the photoreceptor 1, is mounted on a designated region of the photoreceptor 1. The development unit 2 includes a development sleeve 5 which is held, for rotation in the direction indicated by an arrow B, at an opening region of the development unit 2 so as to be positioned next to the photoreceptor 1. The development unit 2 further includes a so-called doctor-blade 8 which is explained later.

The development unit 2 further includes first and second rotatable members 3 and 4 for transferring a development compound to the development sleeve. The first and second rotatable members 3 and 4 are rotatably positioned adjacent to the development sleeve 5 so that the first member rotates in direction D and the second member in direction C. Further, the first and second members 3 and 4 are each provided with a plurality of blades on surfaces thereof for mixing and circulating the development compound which contains particles of toner and carriers. The first and second members 3 and 4 are rotated by a driving unit (not shown) to mix and transfer the development compound so as to circulate the development compound within the development unit 2.

The development unit 2 includes an opening 6, having a relatively long length in a direction perpendicular to the drawing and formed at a specified region of the casing, above the first and second members 3 and 4. A disposable box-shaped development compound container 7 is mounted on the development unit 2 so that an opening 7*c* in the container 7 is adjacent to the opening 6 of the development unit 2.

The development compound container 7 can be secured to the development unit 2 and is detachable therefrom in a relatively simple manner by utilizing a simple hooking method of projections and depressions. As shown in FIG. 1, the development unit 2 includes hooks 2*a* and 2*b,* and the development compound container 7 includes hooks 7*a* and 7*b*. The hook 7*a* is inserted into an opening of the hook 2*a* and the hook 7*b* is hooked by the hook 2*b,* so that users can easily mount the development compound container 7 on and remove it from the development unit 2.

The development unit 2 shown in FIG. 1 is in a state immediately after being mounted with the development compound container 7 thereon. In such a state, the opening 7*c* of container 7 which is sealed by a heat seal 9 remains sealed. The development compound container 7 contains a development compound 10 and a dehumidifying agent 11 which are sealed from ambient conditions by the heat seal 9. The development compound 10 is freely movable inside the development compound container 7, and the dehumidifying agent 11 is fixed by an adhesive agent or the like to an upper region of the container opposite to the sealed opening 7*c*.

The heat seal 9 can easily be removed from the container 7 even when the development compound container 7 is mounted on the development unit 2 as shown in FIG. 1 by using a pealing member (not shown) for pealing off the heat seal 9 from outside the development unit 2. When the heat seal 9 is removed, insides of the development compound container 7 and the development unit 2 are caused to be connected with each other. Then, the development compound 10 which had been sealed inside the development compound container 7 falls into the development unit 2 and the dehumidifying agent 11 remains inside the development unit 2. As noted above, the development compound 10 and the dehumidifying agent 11 are securely contained within the hermetic development compound container 7 until the heat seal 9 is removed. That is, the dehumidifying agent does not become active until the seal 9 is removed.

After falling into the development unit 2, toner included in the development compound 10 is partly consumed during development operations. Additional toner is supplied from a toner bottle 18*a* gripped by a toner supply unit 18 (seen in FIG. 2) into the development unit 2.

As discussed above, the insides of the development compound container 7 and the development unit 2 are connected after the heat seal 9 is removed. The dehumidifying agent 11 then performs a function for dehumidifying the development compound 10 in the development unit 2. The dehumidifying agent 11 has a relatively long active life and can be changed when the carrier is in short supply and the current development compound container 7 is replaced with a new development compound container 7. In this way, the development compound 10 in the development unit 2 is protected from being humidified. Accordingly, the thus dehumidified toner included in the development compound 10 remains at a constant charge level.

Figure 2:
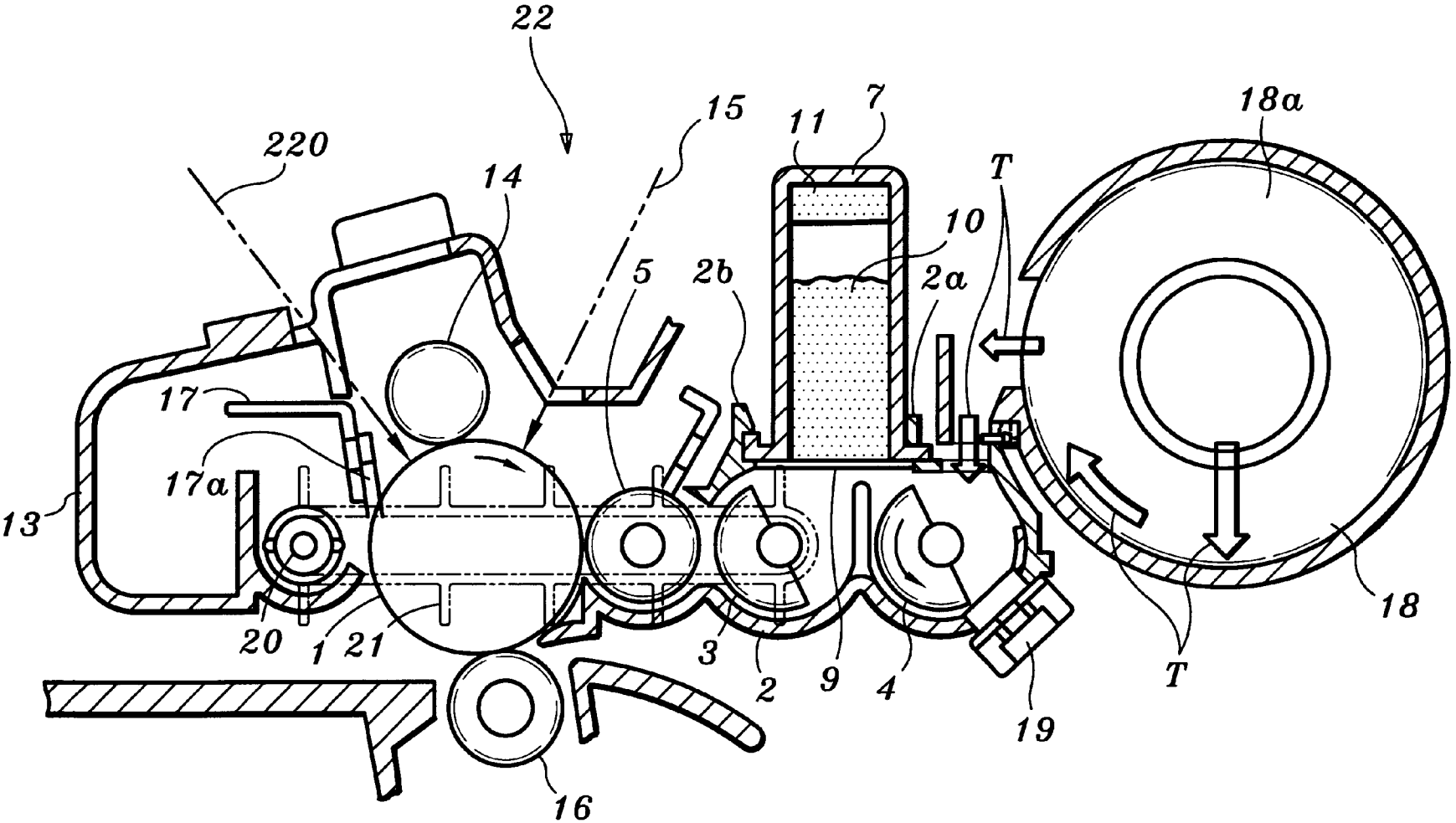
FIG. 2 is a sectional view of a photoreceptor unit and associated elements of the image forming apparatus.

FIG. 2 shows a sectional view of an exemplary photoreceptor unit 22 with associated elements provided in the image forming apparatus according to the present application. As is shown in FIG. 2, the development unit 2 and a photoreceptor case 13 for securing a photoreceptor 1, which is included in the photoreceptor unit 22 and forms an electrostatic latent image on the surface thereof, are integrally configured and form the photoreceptor unit 22.

An exposure writing unit (not shown) generates an intensively modulated light beam 15 in accordance with image information. A surface of the photoreceptor 1, which rotates clockwise and is evenly charged by a charging roller 14, is then exposed to the light beam 15 so that an electrostatic latent image is formed thereon in accordance with the image information.

During an image development process, the electrostatic latent image formed on the surface of the photoreceptor 1 is developed into a visible image formed with toner in the development compound transferred by a development sleeve 5. In parallel with this image development process, a transfer paper sheet is fed from a paper feed unit (not shown) to a transfer roller 16 charged to a transfer bias charge level by a power supply unit (not shown.) When the transfer paper sheet passes through a so-called nip region formed between the transfer roller 16 and the photoreceptor 1, the toner image is forcibly transferred onto the transfer paper sheet by an attractive force from the charged transfer roller 16. After having been disengaged from the photoreceptor 1, the transfer paper sheet passes through a fixing unit (not shown), in which the toner image is fixed to the paper sheet and then discharges the sheet from the image forming apparatus.

After the image transfer operation is performed, the rotating photoreceptor 1 is cleaned by a cleaning blade 17*a* of a cleaning unit 17 so that the toner remaining on the surface of the photoreceptor 1 is removed, e.g., the toner is scraped off. At the same time, the rotating photoreceptor 1 is uncharged by being exposed to a charge-quenching beam 220 generated by a charge-quench beam generator (not shown).

The toner removed from the photoreceptor 1 by the cleaning blade 17*a* falls into a container formed by a part of the photoreceptor case 13. Then, the removed toner is transferred by a rotary transfer screw 20 to one side of the container in the axis direction of the transfer screw 20, so that the toner is moved onto a recycle belt 21. Then, the removed toner is returned to the development unit 2 by the recycle belt 21. The toner returned to the development unit 2 is then mixed with new toner supplied from a toner bottle 18*a* mounted in a toner supply unit 18, by first and second members 3 and 4, and is again transferred onto the development sleeve 5.

Toner from the toner bottle 18*a* held by the toner supply unit 18 flows through the paths indicated by arrows T and is deposited into the development unit 2 through the opening 6 formed above the second member 4. The toner included in the development compound in the development unit 2 is thus replenished.

The development unit 2 includes a toner density detect sensor 19 which is preferably positioned adjacent to the second member 4 for detecting toner density of the development compound in the development unit 2. Preferably, the sensor 19 is capable of sensing the density of two-component type compounds, but is also capable of sensing the density of other types of compounds as well. The toner density detection is achieved by, for example, detecting magnetic permeability of the two-component development compound. On the basis of the information thus detected by the toner density detect sensor 19, an amount of toner supplied from the toner bottle 18*a* is controlled. Details of this control operation are explained later.

Figure 3:
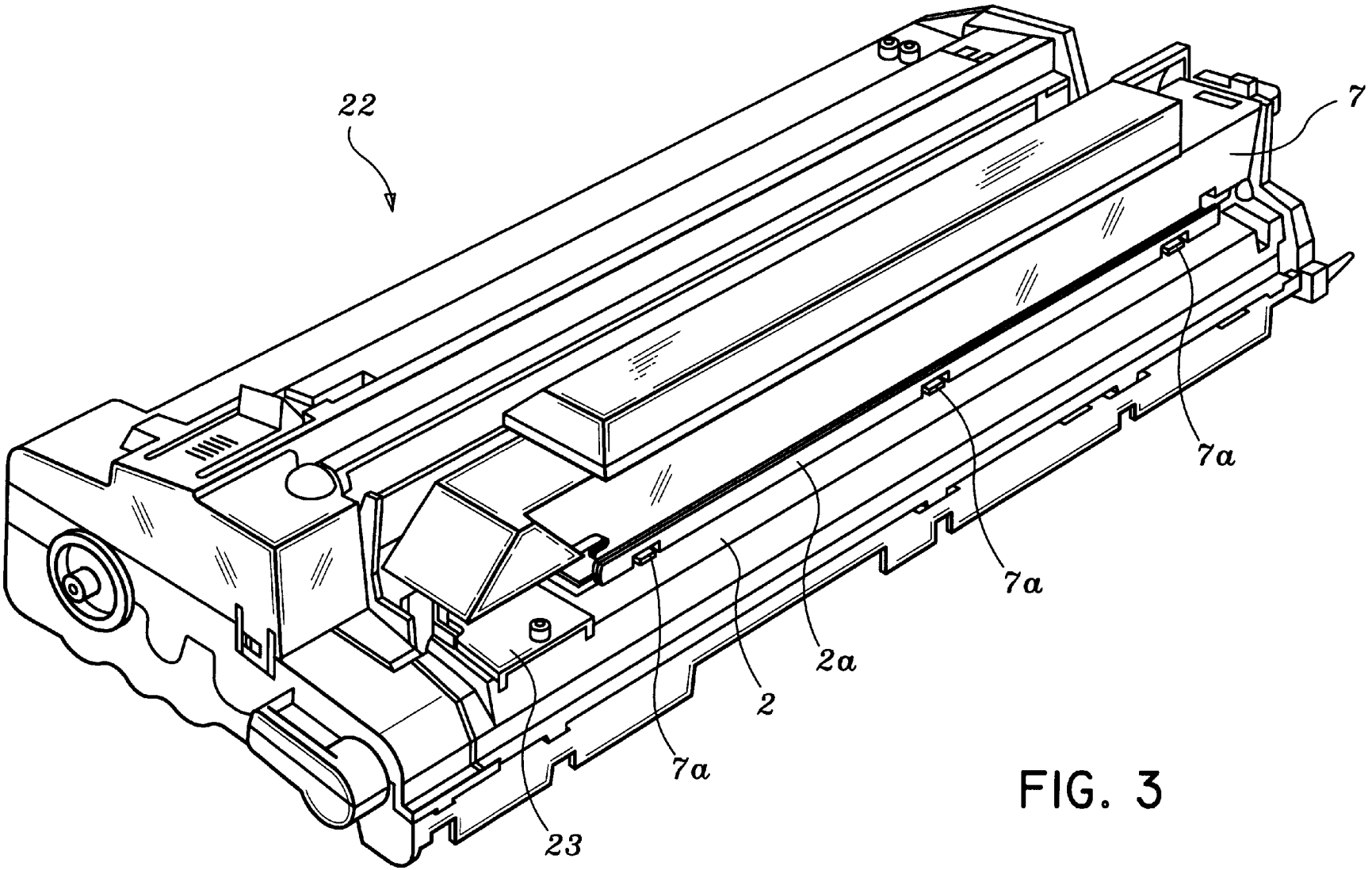
FIG. 3 is a perspective view of the photoreceptor unit shown in FIG. 2.
Figure 4:
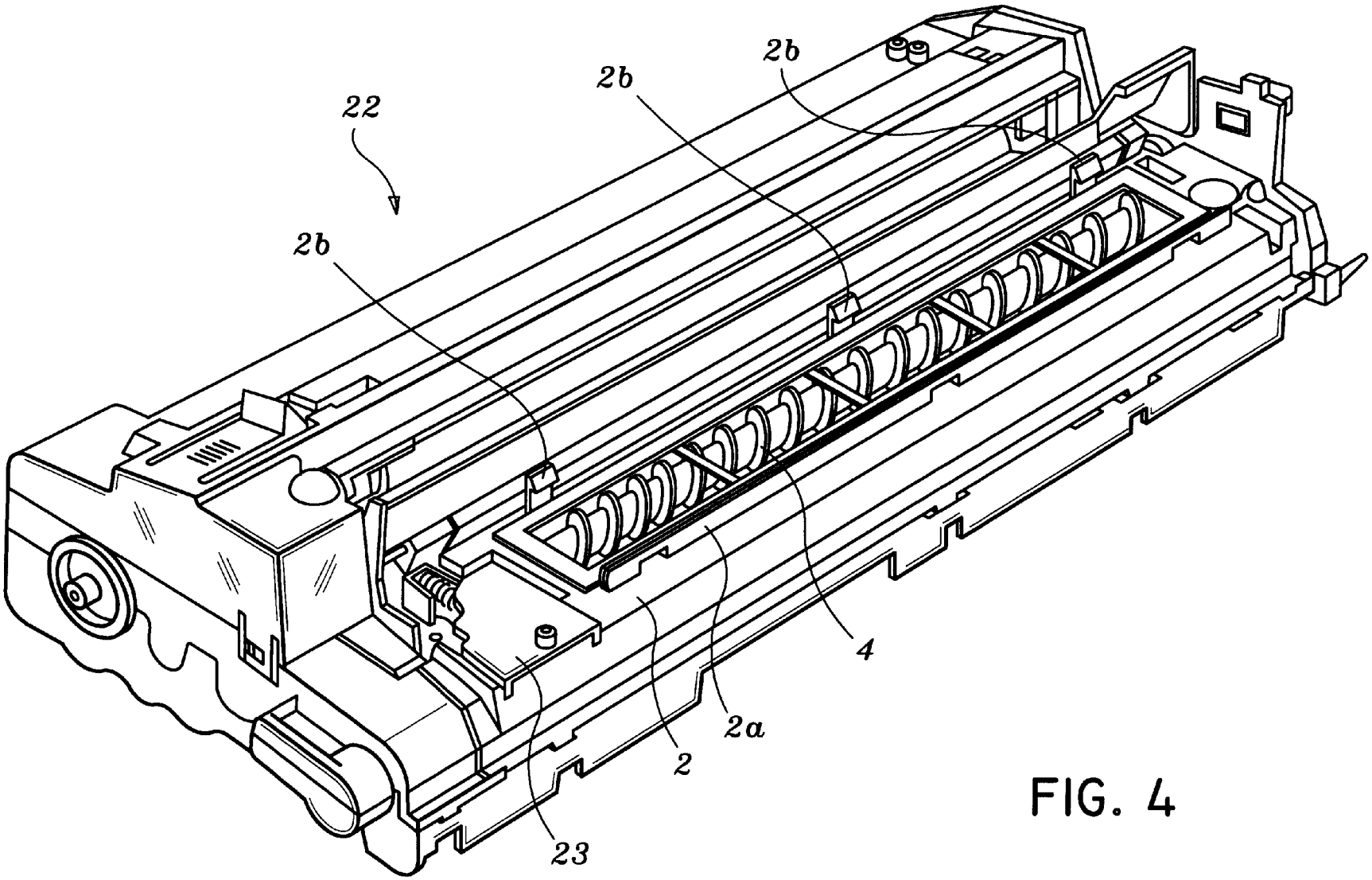
FIG. 4 is a perspective view of the photoreceptor unit shown in FIG. 3 with a front portion thereof cutaway.

External perspective views of the photoreceptor unit 22 are shown in FIGS. 3 and 4; the view with the development compound container 7 mounted on the development unit 2 in FIG. 3, and the view without the development compound container 7 in FIG. 4. As is explained herein above, the development compound container 7 is so designed for easy attachment and removal. More specifically, as shown in FIG. 3, the development unit 2 includes hooks 2*a* and 2*b* (FIG. 4), and the development compound container 7 includes hooks 7*a* and 7*b* (FIG. 1). The hook 7*a* is inserted into an opening of the hook 2*a* and the hook 7*b* (FIG. 1) is hooked by the hook 2*b* (FIG. 4), so that the development compound container 7 can securely be mounted on and easily be removed from the development unit 2 by users. An open-and-close lid 23 provided in the development unit 2 of the photoreceptor unit 22 allows the admission of the development compound 10 into the inside of the development unit 2 from the toner bottle 18*a* when the open-and-close lid 23 is in an open state.

Figure 5:
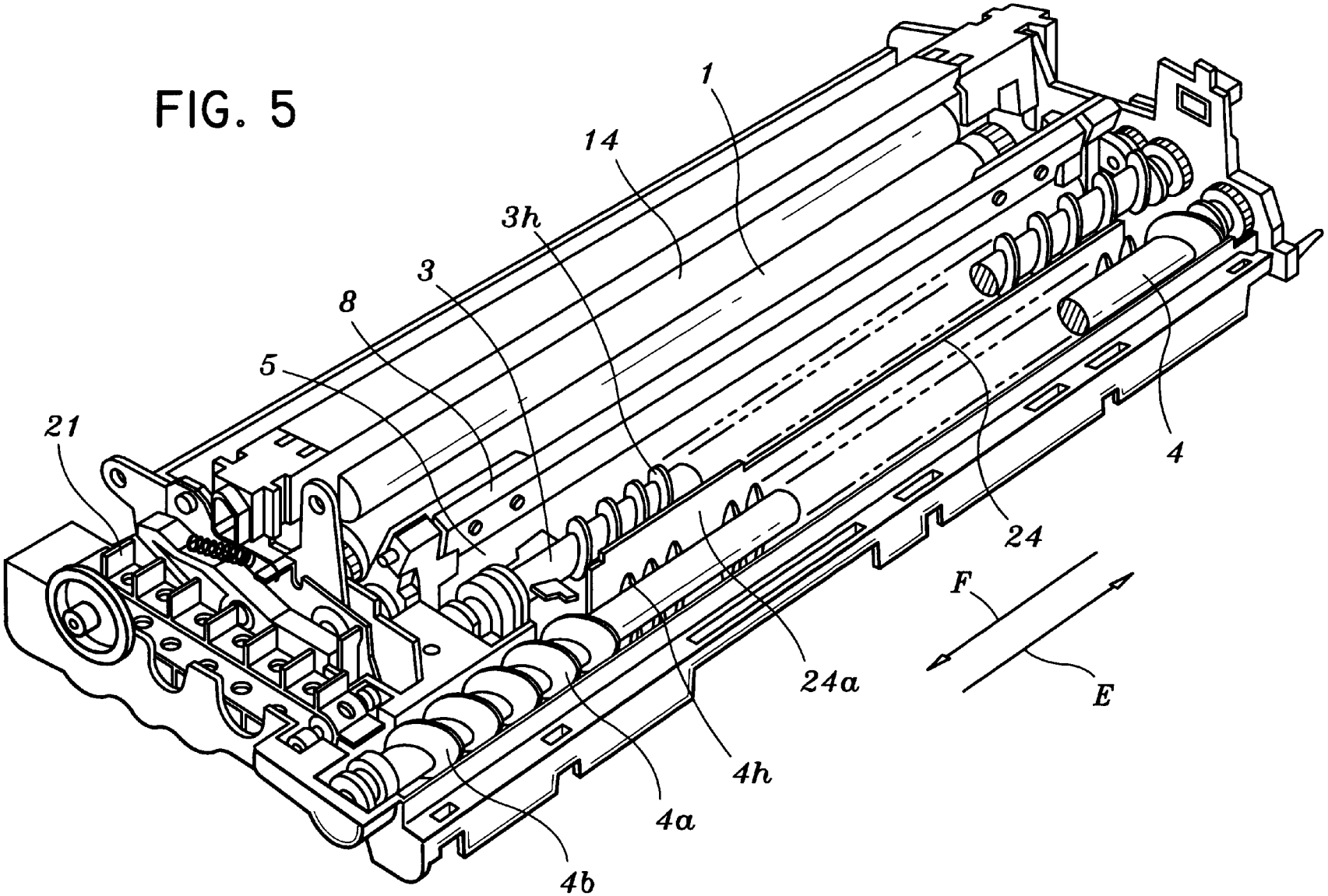
FIG. 5 is another perspective view of the photoreceptor unit shown in FIG. 3 with a front portion thereof cutaway.

Next, a further detailed flow of the development compound 10 in the development unit 2 is explained with reference to the illustration of the photoreceptor unit 22 shown in FIG. 5. As illustrated in FIG. 5, the second member 4 has the length of the first member 3 and an additional length extended in the right hand side of the photoreceptor unit 22 in the drawing. A single-screw thread 4*a* is formed along the length of this additional portion of the second member 4. Further, a plurality of half-ellipse-shaped wings 4*h* are formed, with a slight slant angle relative to the axis of the second member 4, along the length of the remaining portion of the second member 4 on which the screw thread is not formed. With the screw thread and the wings thus formed along the length of the second member 4, the development compound may be mixed and transferred in the direction indicated by an arrow E in FIG. 5 when the second member 4 rotates in the direction indicated by the arrow C in FIG. 1.

The first member 3 is provided with a plurality of half-ellipse-shaped wings 3*h* along its length, corresponding to the manner in which the plurality of half-ellipse-shaped wings 4*h* are formed, so that the development compound is transferred in the direction indicated by an arrow F in FIG. 5 when the first member 3 rotates in the direction indicated by the arrow D in FIG. 1.

In addition, a divider 24 is mounted between the first and second members 3 and 4, and divides a space between one for the first member 3 and the other for the second member 4, so as to form a flow route of the development compound 10 within the development unit 2.

The development sleeve 5 includes a fixed axis having a five-pole magnet. Further, the development sleeve 5 includes a non-magnetic pipe-shaped member which covers the exterior surface of the above-mentioned fixed axis and which is driven for rotation by a driving unit (not shown). The thus structured development sleeve 5 attracts the development compound 10, by its magnetic attractive force, during a time the development compound 10 is transferred in the arrow F direction by the first member 3. In this way, the development compound 10 is transferred to the development sleeve 5.

The development compound 10, which is not transferred to the development sleeve 5, moves from the first member 3 side to the second member 4 side through a region out of the divider 24 around the left end of the first member 3 in the drawing. Then, the development compound 10 is further transferred in the arrow E direction and still further transferred to the first member 3 side through the region out of the divider 24 around the right ends of the first and second members 3 and 4 in the drawing. In this way, the development compound 10 is principally circulated by the first and second members 3 and 4 between two areas divided by the divider 24 as described above.

The development compound 10, attracted by the magnetic force and transferred onto the surface of the development sleeve 5, is further forwarded towards the region, where the doctor-blade 8 is closely mounted, by the rotation of the development sleeve 5. As shown in FIG. 1, the doctor-blade 8 is mounted close to the surface of the photoreceptor 1 so as to regulate the admission of the development compound 10 into a gap formed between the photoreceptor 1 and the doctor-blade 8. Subsequently, the regulated development compound 10 passes through another gap formed between the photoreceptor 1 and the development sleeve 5 and, during this period, the toner included in the development compound 10 is caused to develop an electrostatic latent image on the photoreceptor 1.

During the above-mentioned development operation, the open-and-close lid 23, provided in the development unit 2 of the photoreceptor unit 22 as shown in FIGS. 3 and 4, is caused to open and allows the admission of the development compound 10 into the inside of the development unit 2 from the toner bottle 18*a*. The position of the toner supply from the toner bottle 18*a* to the development unit 2 is located at a region away from the divider 24 and the wings 4*h* and close to an innermost screw portion 4*a* of the second member 4, as shown in FIG. 5. On the other hand, the recycling toner returned from the photoreceptor 1 with a recycle belt 21 in FIG. 5 is supplied onto an outermost screw portion 4*b* of the second member 4.

In this way, the recycle toner is sent back to the development unit 2 through the region around the outermost screw portion 4*b* and the new toner is supplied to the development unit 2 through the region around the innermost screw portion 4*a*. Subsequently, the recycle toner and the new toner are mixed together by the rotation of the screw of the second member 4. Then, the mixed recycled and new toner is sent to the region of the above-mentioned circulating development compound 10, and is then mixed with the development compound 10 by the wings 4*h*.

The toner at an early mixing stage has an unstable electric charge and is therefore undesirable to be used for a development operation through a shortcut of the circulation loop over the divider 24. Accordingly, the divider 24 has a portion 24*a* which covers a region, in which the development compound 10 is at the early mixing stage, and which is therefore formed higher than other portions. Consequently, no development compound 10 at the early mixing stage can be transferred to the first member 3 side over the divider 24 and used for a development operation.

Figure 6:
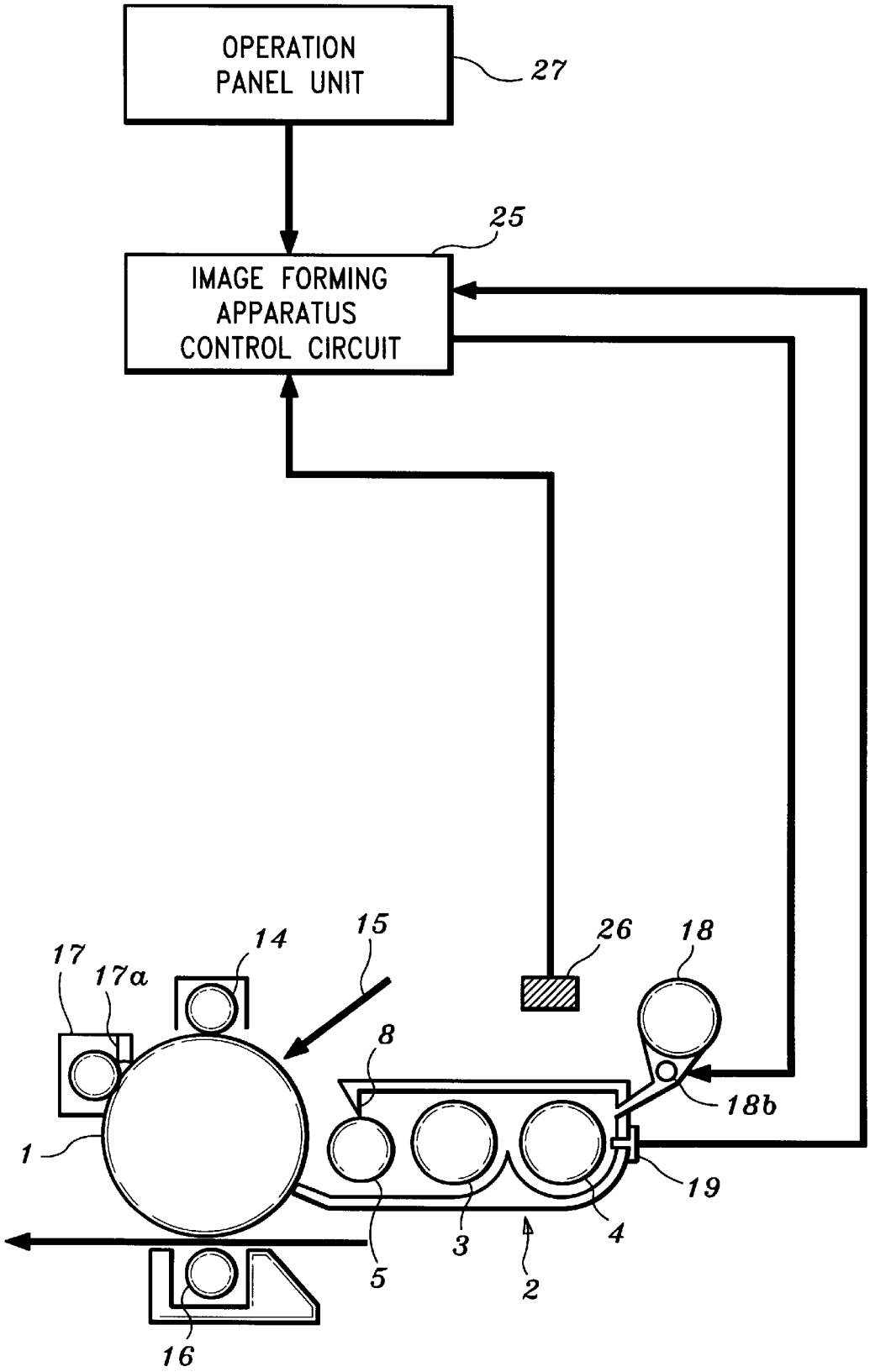
FIG. 6 is an illustration for outlining an overall operation of the image forming apparatus.

Next, an outline of an image forming apparatus control circuit is explained with reference to FIG. 6. Reference numeral 18*b* in FIG. 6 is a toner supply driver for driving the toner supply unit 18 so as to replenish the toner in the development unit 2 from the toner bottle 18*a*. The toner supply driver 18*b* includes a motor and a clutch and is controlled by an image forming apparatus control circuit 25 which includes a central processing unit (CPU). Reference numeral 26 designates a humidity sensor for detecting humidity in the image forming apparatus. Reference numeral 27 designates an operation panel unit constructed of a plurality of keys which users operate and a display portion.

The image forming apparatus control circuit 25 controls each part of the image forming apparatus using input signals from the toner density detect sensor 19, the humidity sensor 26, the operation panel 27 so as to perform the aforementioned image forming operation as well as other functions.

Figure 7A:
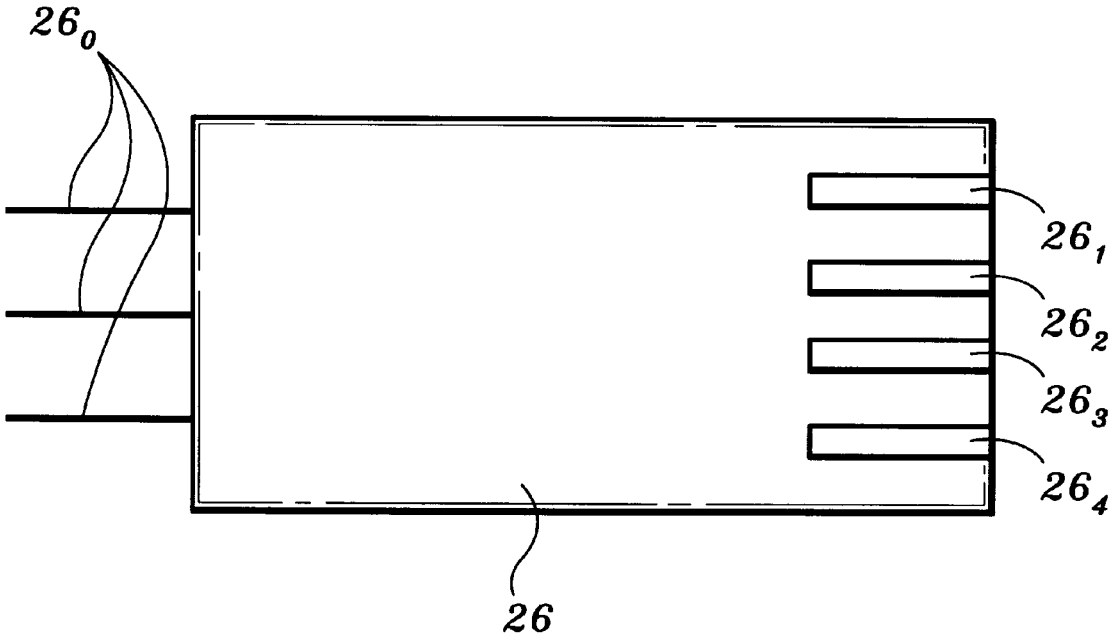
FIGS. 7(*a*) and 7(*b*) are front and side views of a humidity sensor, respectively.
Figure 7B:
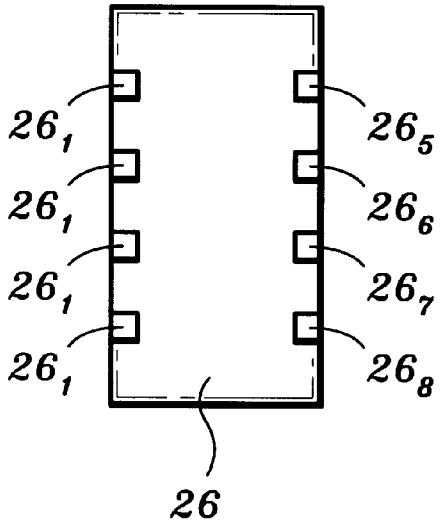

The humidity sensor 26, which includes a plurality of humidity sensing elements $\mathbf{26}_1$ to $\mathbf{26}_8$ and lead wires $\mathbf{26}_0$, as shown in FIGS. 7(*a*) and 7(*b*). Various types of humidity sensors may be used. For example, the humidity sensor may be an absolute humidity sensor for detecting absolute humidity. The humidity sensor may be a relative humidity sensor for detecting relative humidity. The absolute humidity sensor detects an amount of moisture in fixed cubic contents. Relative humidity can be measured by performing calculations using the detected value of the aforesaid absolute humidity and a value of temperature which is additionally needed to be detected. Unlike the absolute humidity sensor, the relative humidity sensor can directly lead to a value of relative humidity on the basis of values of humidity and condensation state. The relative humidity sensor also indicates a humidity value varying with temperature while the absolute humidity sensor indicates a humidity value constant at any degree of temperature.

In the image forming apparatus applying to this embodiment of the present application, heat is generated at various portions, such as motors, a fixing unit, a charging unit, an optical exposure unit. Therefore, values of temperature are varied between these portions. As noted above, humidity (relative humidity) varying with temperature in the image forming apparatus affects electric charges on the toner, which is typically caused by friction among toner particles.

More specifically, the amount of electric charge of the development compound varies with the moisture content in air, i.e., the charge amount reduces as the humidity increases (relative humidity) and the charge amount increases as the humidity decreases (relative humidity). Therefore, it is needed to adjust the toner density to a higher level during a time of lower humidity so as to reduce the electric charge amount of the development compound in order to maintain a constant image density. In a similar manner, it is also needed to adjust the toner density to a lower level during a time of higher humidity so as to increase the electric charge amount of the development compound in order to maintain a constant image density.

As noted above, relative humidity reduces with increasing temperature while absolute humidity remains as it is with increasing temperature. Accordingly, during a time of high temperature, relative humidity is reduced and the electric charge amount of the development compound is increased.

Based on such nature of humidity, the image forming apparatus performs a toner density correction (later explained) so as to form an image with an appropriate toner density. More specifically, a toner density control is performed on the basis of a detected change in the electric charge of the development compound by using the relative humidity sensor 26. In this way, a need of a separate sensor for temperature in addition to an absolute humidity sensor can be avoided by using a relative humidity sensor.

The humidity sensor 26 is provided to detect humidity inside of the image forming apparatus. However, an air flow within the image forming apparatus may disturb an operation of the humidity sensor 26 to accurately detect humidity. As mentioned above, heat is generated in the embodiment of the image forming apparatus according to the present invention. Accordingly, the embodiment of the image forming apparatus according to the present invention includes a housing provided with a plurality of holes on an outer surface thereof. The plurality of holes are used to let out heat from the inside of the image forming apparatus or to let in low temperature air from outside into the image forming apparatus.

Figure 8:
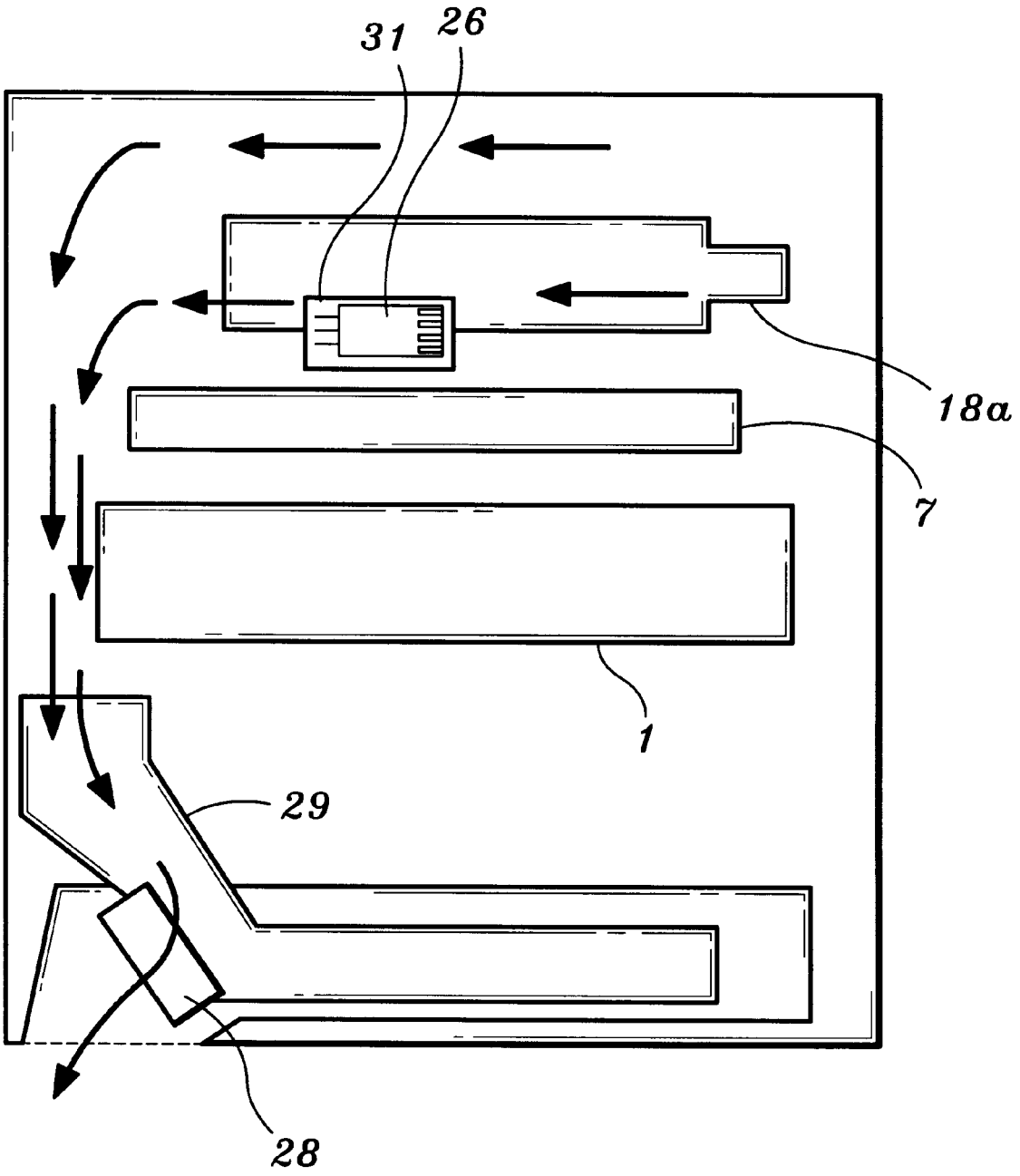
FIG. 8 is a partial diagrammatic top view of the novel image forming apparatus for explaining air flow through the apparatus.

By the thus arranged holes in the housing, an air flow is generated in the directions indicated by arrows in FIG. 8 in the image forming apparatus. As shown in FIG. 8, an exhaust unit 28 including an eject fan ejects air, which is gathered via a duct 29 mounted inside the apparatus, through the plurality of holes provided in the housing. A region around the duct 29 may accordingly be heated because of hot air passing through the duct 29. Consequently, the humidity sensor 26 is not desirably located at this region around the duct 29. In addition, an air flow can also be generated by a motion of paper transferring inside the apparatus.

The humidity sensor is preferably positioned within the apparatus at a place where air flow does not significantly inhibit accurate operation of the humidity sensor. One such location is at an approximate center of the apparatus in the longitudinal direction of the apparatus and an approximate center of the development unit 2 in the longitudinal direction of the development unit 2 and above the development unit 2.

Figure 9:
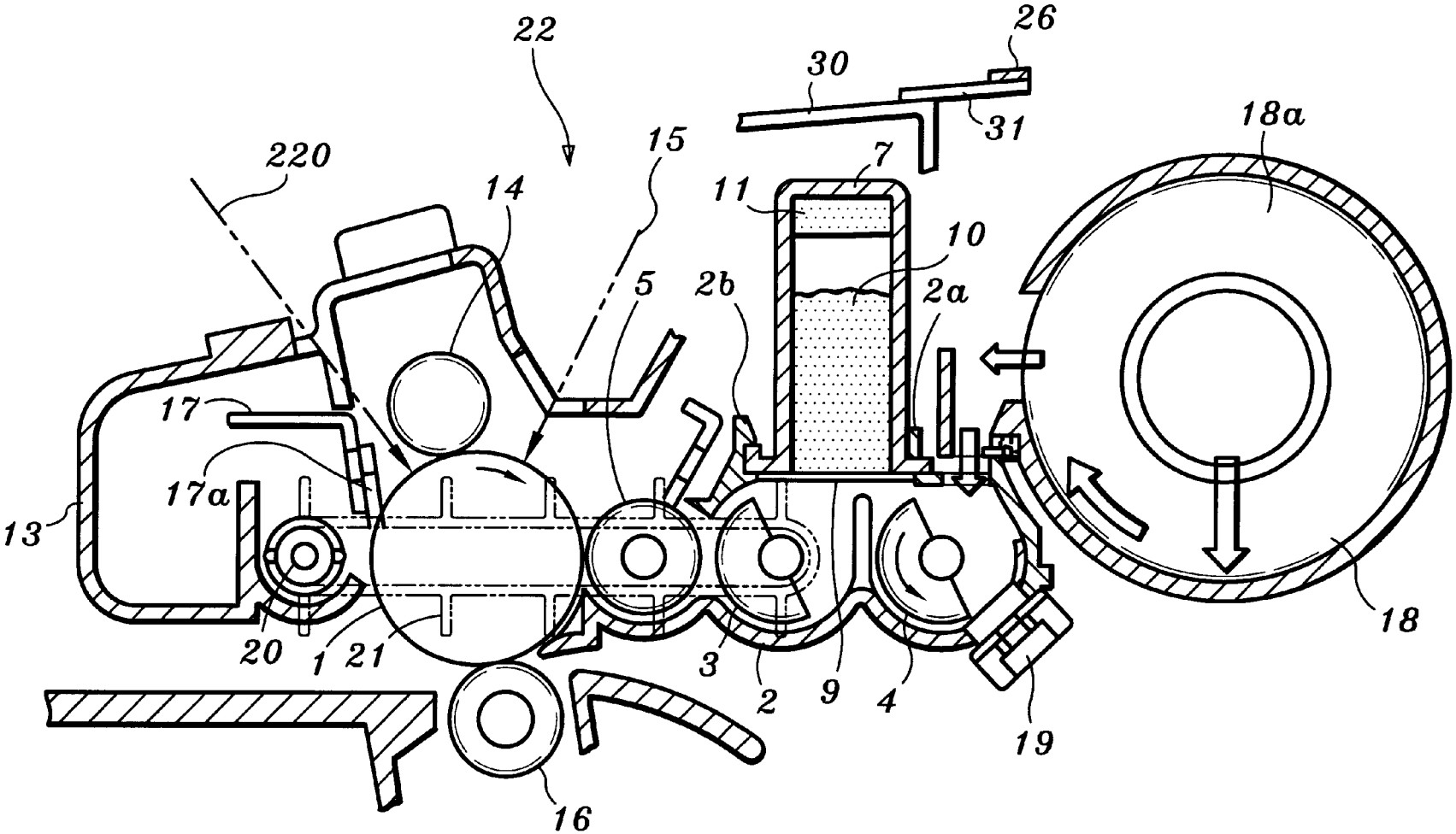
FIG. 9 is another sectional view of the photoreceptor unit and the associated elements shown in FIG. 2, with a humidity sensor mounted.

More specifically, as shown in FIG. 9, the humidity sensor 26 is horizontally positioned so that the air flow, in which the air flows in the horizontal direction, may not be broken among the plurality of humidity sensing elements $\mathbf{26}_1$ to $\mathbf{26}_8$, and a lead wires $\mathbf{26}_0$. Further, the humidity sensor 26 is secured on a plate-shaped bracket 31 fixed to a supporting member 30. The supporting member 30 is positioned above the development unit 2 and directly mounted on the interior of the image forming apparatus so as to hold the humidity sensor 26 at the above-mentioned desired place. The thus arranged humidity sensor 26 can successfully detect humidity even in a condition in which a slight air flow is caused.

The image forming apparatus, has an opening (not shown) for receiving the disposable development unit 2 or the disposable photoreceptor unit 22 mounted with the disposable development unit 2, includes an inner cover (not shown) mounted at the front side of the apparatus. The inner cover (not shown) is provided to protect the humidity sensor 26 from causing a collision with the disposable development unit 2 or the disposable photoreceptor unit 22 during a time of their insertion through the opening (not shown) into the apparatus. Further, the image forming apparatus includes a guide rail (not shown) for guiding the development unit 2 or the photoreceptor unit 22 when inserted into the apparatus through the opening (not shown) of the apparatus. Thereby, the disposable development unit 2 or the disposable photoreceptor unit 22 mounted with the disposable development unit 2 can smoothly be inserted into and removed from the front and in the longitudinal direction of the apparatus, along the guide rail (not shown) and through the opening, without causing a collision with other members such as the humidity sensor 26 and the inner cover (not shown) mounted in the apparatus.

More specifically, a distance between a mounting position of the humidity sensor 26 and the top surface of the development compound container 7 mounted on the development unit 2, which is for example 19 mm, is arranged to be larger than a distance (e.g., 5 mm) made between a mounting position of the inner cover (not shown) and the top surface of the development compound container 7 when inserting the development unit 2 into the apparatus.

Next, a control operation of the image forming apparatus control circuit 25 is explained with reference to the flowchart shown in FIG. 10. The image forming apparatus control circuit 25 performs an operation shown in the flowchart of the FIG. 10 at each completion of the image forming operation for one page.

In Step S1, the control circuit 25 reads sampling data representing output values $V_t$ from the toner density detect sensor 19 and then determines average output value $V_{t/ave}$ of the above-mentioned sampling data. Reference value $V_{ref}$, with which appropriate image density is obtained, is predetermined and is compared with the output values from the toner density detect sensor 19, for adjusting image density.

In Step S2, the control circuit 25 determines a difference in degree of image density between the predetermined reference value $V_{ref}$ and the average output value $V_{t/ave}$. The difference $dV_t$ can be expressed as follows: $V_{t/ave}-V_{ref}=dV_t$.

With the above-mentioned appropriate image density, an image can be formed in a superior quality without having problems of a shortage or an excess of toner.

Then, the control circuit 25 proceeds to Step S3 and reads humidity sampling data representing output values from the humidity sensor 26. Further in Step S3, the control circuit 25 determines an average value of the above-mentioned humidity sampling data. Still further in Step S3, the control circuit 25 adjusts the value of $dV_t$ in accordance with the average value of the aforesaid humidity sampling data. As a result, the control circuit 25 can determine a corrected difference, $dV_{t/c}$, with which variation of the electric charge of toner can be eliminated and the electric charge of toner can stably remain at a predetermined level with which appropriate image density is obtained.

In the image forming apparatus, an output value of the humidity sensor 26 maintains an approximate-linear relationship with varying humidity within a range between 1.0 and 3.5 volts. Accordingly, the control circuit 25 performs the operation of adjusting the value of $V_{ref}$ in accordance with the output value from the humidity sensor 26 when the output value of the humidity sensor 26 is within the range between 1.0 and 3.5 volts.

Then, the image forming apparatus control circuit 25 proceeds to Step S4 and determines whether value of $dV_{t/c}$ is larger than zero. Output value $V_t$ from the toner density detect sensor 19 has a nature to become smaller with increasing grade of toner density. Therefore, when the value of $dV_{t/c}$ is not larger than zero, meaning that the inequality $V_{t/ave}>V_{ref}$ is not satisfied, the result of Step S4 becomes NO which means that the degree of the current image density is greater than that of the appropriate image density. In this case, the control circuit 25 proceeds to Step S10 and performs an operation of reducing an amount of the toner supply since the current image density is judged as greater than that of the appropriate image density. During the operation of reducing an amount of the toner supply, various actions are taken. For example, counting values $C_1$ and $C_2$ are reset to 0 (zero), a toner supply level $L_{td}$ is decremented by one, and, if an amount of toner is in a status of an near end, the near end status is cleared. Then, in Step S11, the control circuit 25 ends the program.

When the degree of the current toner density is smaller than that of the appropriate image density, meaning that the inequality $V_{t/ave}>V_{ref}$ is satisfied, the result of Step S4 becomes YES which means that the degree of the current image density is not greater than that of the appropriate image density. In this case, the image forming apparatus control circuit 25 proceeds to Step S5 and increments $C_1$ by one, which represents numbers of the image forming operations consecutively performed under the condition in which the degree of toner density is smaller than that of the appropriate image density. Then, the control circuit 25 further proceeds to Step S6 and determines whether the value of $C_1$ is equal to or larger than a predetermined value such as 10, for example.

When the value of $C_1$ is smaller than the predetermined value 10, the result of Step S6 becomes NO. In this case, the control circuit 25 proceeds to Step S7 and determines an amount of toner to be supplied to the development unit 2 from the toner supply unit 18. In this event, the control circuit 25 determines the amount of toner in accordance with toner supply level $L_{td}$, in a manner in which the amount of toner is increased with increasing value of $L_{td}$. The toner supply level $L_{td}$ may be provided with a plurality of levels so as to perform an accurate operation of adjusting toner density as humidity varies. In this image forming apparatus, the toner supply level $L_{td}$ is provided with two levels; a relatively less amount of toner is supplied at a first level and a relatively large amount of toner is supplied at a second level, for example. Then, in following Step S8, the image forming apparatus control circuit 25 controls the toner supply driving unit 18*b* to drive the toner supply unit 18 so as to supply the thus determined amount of toner to the development unit 2. Then, the control circuit 25 ends the program.

When the value of $C_1$ is equal to or greater than the predetermined value 10, the result of Step S6 becomes YES. In this case, the control circuit 25 proceeds to Step S12 and determines whether the value of $L_{td}$ is equal to 2 representing the second level. When the value of $L_{td}$ is not equal to 2, the result of Step S12 becomes NO and the control circuit 25 then increments the value of $L_{td}$ by one in next Step S13. Then, the control circuit 25 further proceeds to Step S14 and resets the value of $C_1$ to zero. Subsequently, the control circuit 25 jumps to Step S7. When the value of $L_{td}$ is equal to 2, the control circuit 25 proceeds to Step S15 and determines whether the value of $V_{t/ave}$ is greater than a value of $V_{te}$ which is predetermined to represent a reference value applicable when the toner density is at a so-called toner-end state in which the toner supply unit 18 is out of toner.

When the value of $V_{t/ave}$ is not greater than that of $V_{te}$ and the result of Step S15 therefore becomes NO, the control circuit 25 jumps to Step S7 to perform the further toner supply operation. When the value of $V_{t/ave}$ is greater than that of $V_{te}$ and the result of Step S15 therefore becomes YES, the control circuit 25 determines that the state of the toner supply unit 18 turns into a so-called toner-near-end state in which the toner supply unit 18 is nearly out of toner. Then, the control circuit 25 proceeds to Step S16 and increments counting value $C_2$ by one, which represents numbers of image forming operations consecutively performed under the condition in which the value of $V_{t/ave}$ is equal to or greater than that of $V_{te}$, meaning that the value of currently toner density is equal to or smaller than that of the toner density at the toner-near-end state of the toner supply unit 18. Then, the control circuit 25 further proceeds to Step S17 and instructs the operation panel 27 to indicate that the condition of the toner supply unit 18 is at the toner-near-end state. Subsequently, the control circuit 25 proceeds to Step S18 in which a plurality of further image forming operations even at the toner-near-end state of the toner supply unit 18 is counted so as to assure that an image is formed in an appropriate toner density. In Step S18, the control circuit 25 determines whether the value of $C_2$ representing the further image forming operations even at the toner-near-end state is greater than a predetermined number such as 50, for example.

When the value of $C_2$ is not greater than 50 and the result of Step S18 becomes NO, the image forming apparatus control circuit 25 ends the program. When the value of $C_2$ is greater than 50 and the result of Step S18 becomes YES, the control circuit 25 determines that the state of the toner supply unit 18 turns into a real toner end state. This is because the number of image forming operations, consecutively performed, becomes greater than 50 under the condition in which the value of $V_{t/ave}$ is greater than the value of $V_{te}$ which is predetermined. In this case, the control circuit 25 further proceeds to Step S19 and sets toner end flag $F_{te}$ to one. Then, the control circuit 25 ends the program. When $F_{te}$ is one, the control circuit 25 instructs the operation panel 27 to indicate, for example, a message that the toner bottle 18*a* needs to be replaced. After the used toner bottle 18*a* is replaced, the control circuit 25 resets flag $F_{te}$ to zero.

Next, the operation, performed in Step S3 in the flowchart of FIG. 10, for adjusting reference value $V_{ref}$ in accordance with the detected degree of humidity is further explained with reference to FIG. 11. As explained, the electric charge of toner varies in accordance with changes in humidity. However, the electric charge of toner saturates when humidity exceeds certain upper and lower limits. Due to these properties of toner charge, the image forming apparatus preferably varies reference value $V_{ref}$ with changes in humidity.

Figure 11:
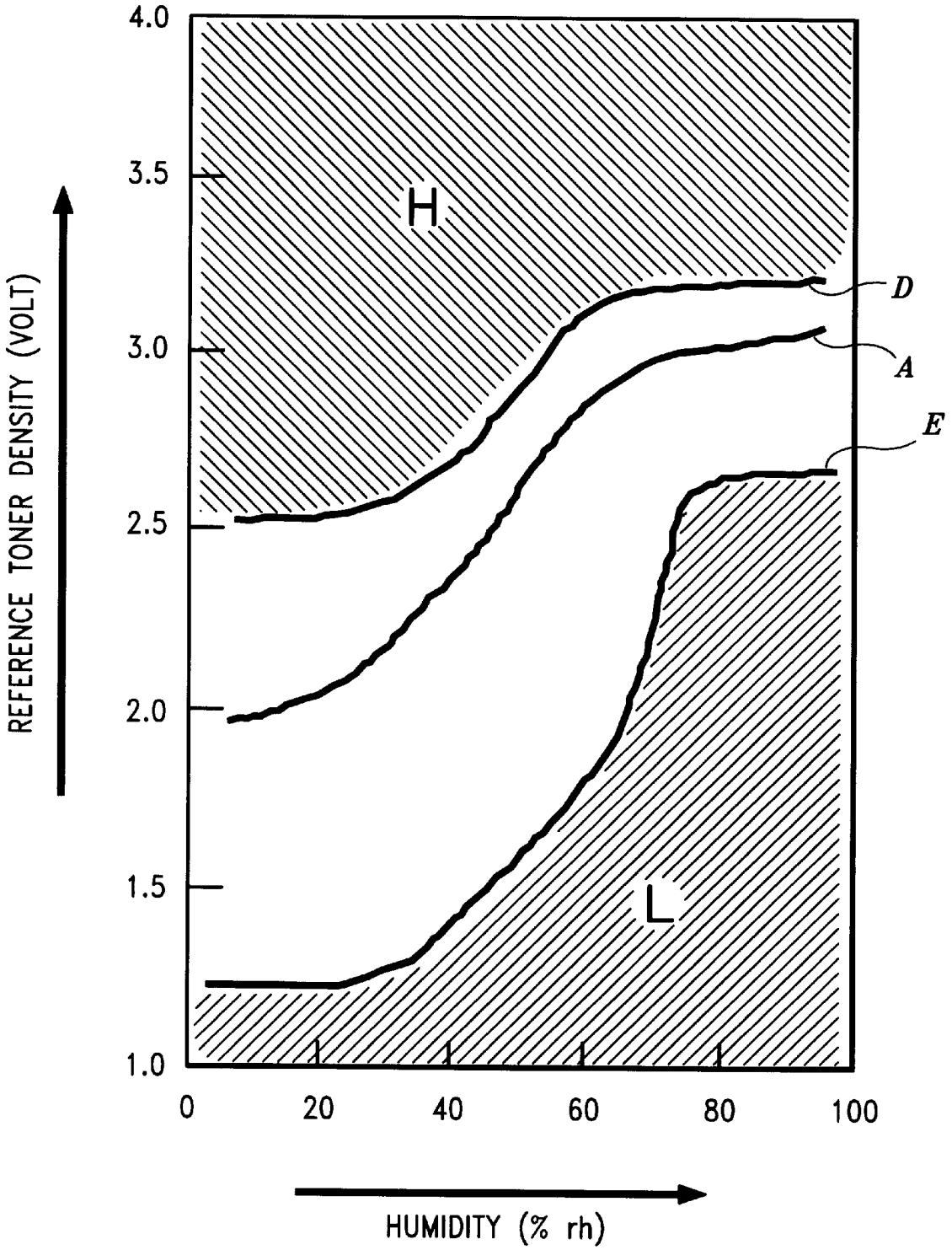
FIGS. 11 and 12 are graphs each for showing potential relationships between humidity and outputs of a toner density detecting sensor.

Among possible relationships between variations of the reference value $V_{ref}$ and humidity, an S-shaped line, indicated as A in FIG. 11, provides the image forming apparatus with a characteristic with which an appropriate image density can be obtained. Further, among the possible relationships between the variations of reference value $V_{ref}$ and humidity, an S-shaped line, indicated as D in FIG. 11, provides the image forming apparatus with a characteristic with which a shortage of toner may be avoided. The S-shaped line D can be used as a limit for the thinnest toner density. Still further, among the possible relationships between the variations of reference value $V_{ref}$ and humidity, an S-shaped line, indicated as E in FIG. 11, provides the image forming apparatus with a characteristic with which an excess of toner may be avoided. The S-shaped line E can be used as a limit for the thickest toner density.

The control circuit 25 also includes a toner-humidity correction table for representing the characteristic of the above-mentioned S-shaped line A, to be used when adjusting reference value $V_{ref}$ to a corrected reference value $V_{ref/c}$ in accordance with output values from the humidity sensor 26. Changing the reference value $V_{ref}$ to the corrected reference value $V_{ref/c}$ is equivalent to adjusting the different value $dV_t$ to a corrected different value $dV_{t/c}$ in accordance with output values from the humidity sensor 26. The toner-humidity correction table may be stored in a memory such as a nonvolatile memory.

Figure 12:
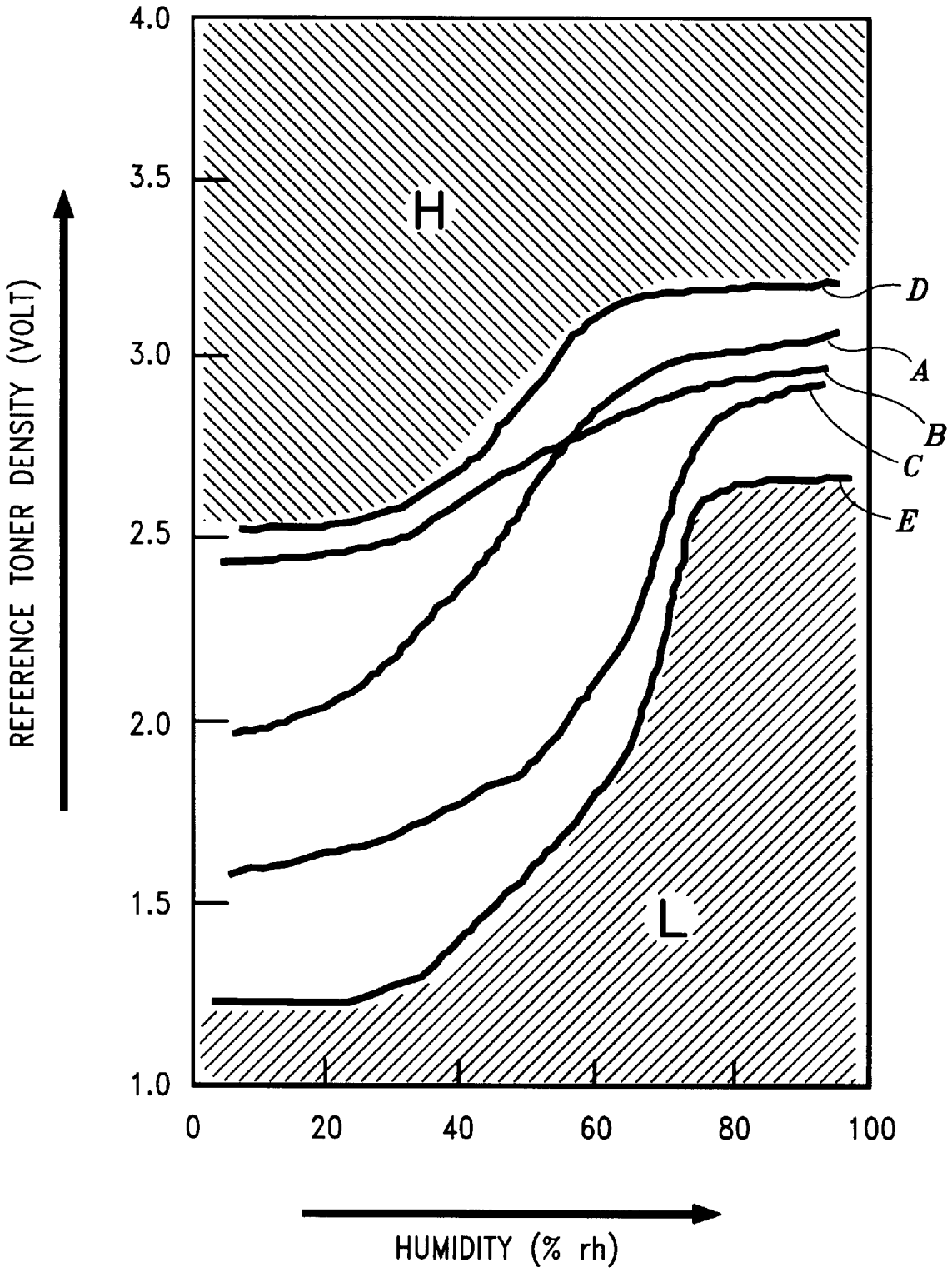

Next, use of a plurality of the toner-humidity correction tables is explained with reference to FIG. 12. The image forming apparatus is provided with a plurality of toner-humidity correction tables which are representatively shown by a plurality of S-shaped lines A to E. The S-shaped lines A, D, and E are similar to those shown in FIG. 11. As noted above, the S-shaped line A represents characteristics of the reference value $V_{ref}$ with which an appropriate image density can be obtained. The S-shaped line D represents characteristics of the reference value $V_{ref}$ with which a shortage of toner may be avoided. The S-shaped line E represents characteristic of the reference value $V_{ref}$ with which an excess of toner may be avoided.

The S-shaped line B represents characteristics of the reference value $V_{ref}$ with which a high quality image can be obtained with thinner toner density and thus a smaller, more economical amount of toner is used. The S-shaped line C represents characteristics of reference value $V_{ref}$ with which an excess of toner can be avoided and an image in superior quality with thicker toner density can be formed with a higher amount of toner.

Data associated with each S-shaped line are stored in correction tables in, for example, a nonvolatile memory. To select one of the characteristics for the reference value $V_{ref}$, an operator may use correction table selection keys provided on, for example, the operation panel 27. Then, a signal represented by the selected toner-humidity correction table is input to the control circuit 25.

Figure 10:
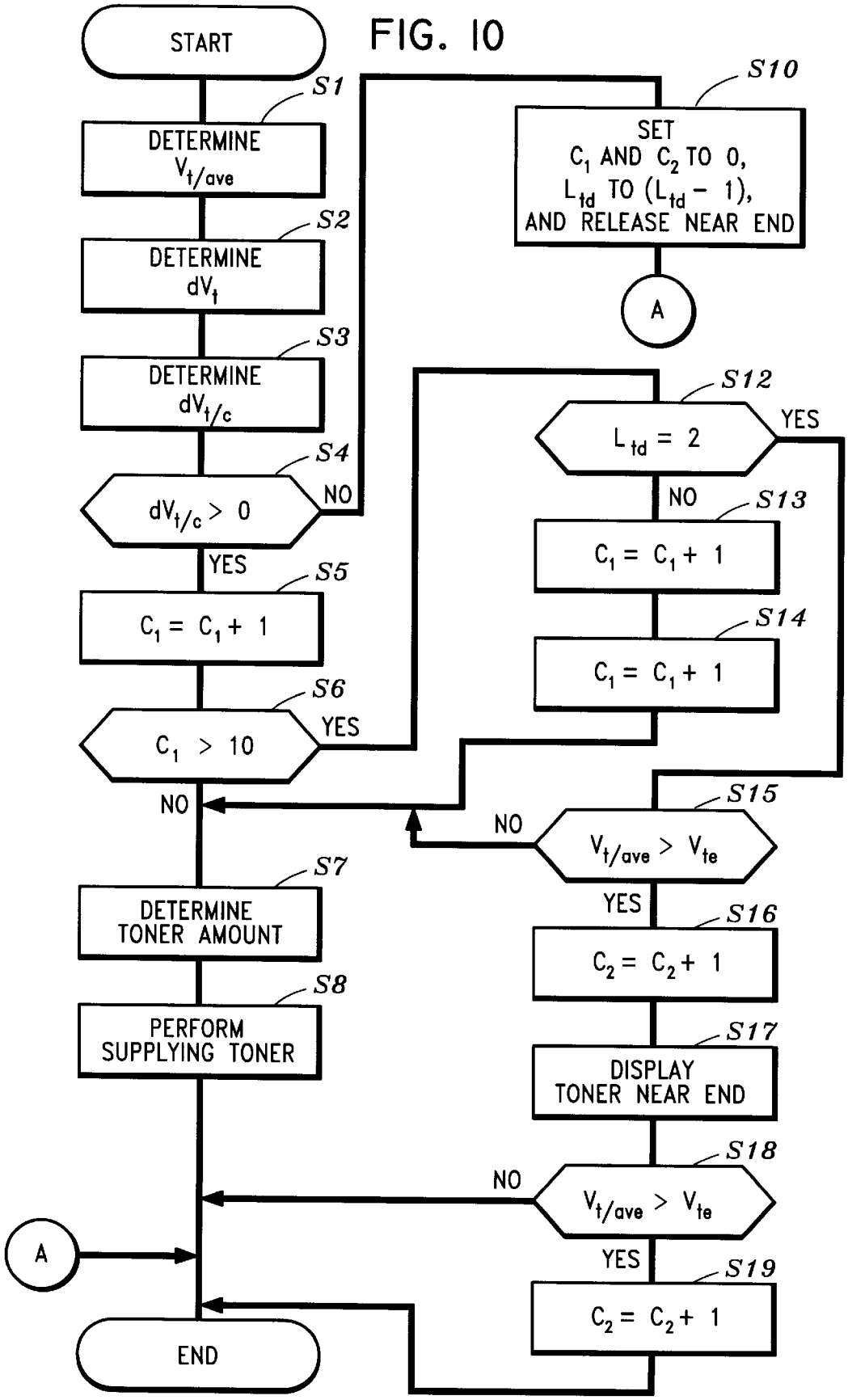
FIG. 10 is a flowchart for explaining how a correction of toner density is performed.

In Step S3 of FIG. 10, the control circuit 25 adjusts $V_{ref}$ to the corrected $V_{ref/c}$ or adjusts $dV_t$ to $dV_{t/c}$, in response to the correction table selected by the user.

Next, a solution for a problem of an image forming with toner shortage caused when humidity is below a predefined limit is explained. This problem is caused because the electric charge of toner saturates when humidity is below the limit and, as a result, toner density may become excessively thin relative to the desired toner density.

Each one of the plurality of the toner-humidity correction tables includes relatively large variation amounts for changing the reference value $V_{ref}$ when humidity is relatively low. In the thus arranged image forming apparatus, in Step S3 of FIG. 10, the control circuit 25 adjusts $V_{ref}$ to the corrected $V_{ref/c}$, in accordance with an instruction by a user for instructing which toner-humidity correction table is referred. The control circuit 25 receives a signal, via toner-humidity selection keys provided on the operation panel 27, for requesting an adjustment of the reference value $V_{ref}$ in response to variations of humidity. Accordingly, the control circuit 25 selects a toner-humidity correction table from among the plurality of the toner-humidity correction tables stored in the memory in response to variations of humidity detected by the humidity sensor 26.

This invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Obviously, numerous additional modifications and variations of the present invention are possible in light of the above teachings. It is therefore to be understood that within the scope of the appended claims, the present invention may be practiced otherwise than as specifically described herein.

What we claim is:

1. An image forming apparatus, comprising:

image developing means for developing an image based on an electrostatic latent image formed on an image bearing surface;

toner supplying means for supplying toner to said image developing means;

toner density detecting means for detecting toner density inside said image developing means;

humidity detecting means for detecting toner humidity, said humidity detecting means being located at a position where said humidity detecting means can detect humidity of air around said image developing means and where said humidity detecting means is minimally affected by heated air;

controlling means for controlling said toner supplying means on the basis of toner density detected by said toner density detecting means and adjusting a degree of said toner density in accordance with variations of humidity detected by said humidity detecting means;

toner density controlling means for making a comparison of output values of said toner density detecting means and a predetermined reference toner density value, and for controlling said toner supplying means in accordance with a result of said comparison; and reference density adjusting means for changing a value of said predetermined reference toner density in accordance with variations of humidity detected by said humidity detecting means, wherein said reference density adjusting means includes a plurality of toner-humidity correction tables, each table containing data representing appropriate toner density varied as humidity varies, for representing different characteristics in conjunction with toner density, uses a selected one of said plurality of toner-humidity correction tables in response to variations of humidity detected by said humidity detecting means and changes said predetermined reference toner density in accordance with said selected toner-humidity correction table in response to variations of humidity detected by said humidity detecting means.

2. The image forming apparatus according to claim 1, wherein said image developing means, toner supplying means, toner density detecting means, and humidity detecting means are located in an enclosure, and wherein said humidity detecting means detects humidity in said enclosure.

3. The image forming apparatus according to claim 1, wherein said humidity detecting means is located at a position which is inside of said image forming apparatus over said image developing means and at an approximate center of said image developing means relative to a longitudinal direction of said image developing means.

4. The image forming apparatus according to claim 1, wherein said reference density adjusting means changes said value of said predetermined reference toner density to an extent within a range in which a value of humidity and output values of said humidity detecting means have a relationship of an approximate linear form.

5. The image forming apparatus according to claim 1, wherein, when humidity is relatively high, said reference density adjusting means changes said value of said predetermined reference toner density to a value higher than a value to which said predetermined reference toner density would normally be set.

6. The image forming apparatus according to claim 1, wherein said reference density adjusting means changes a value of said predetermined reference toner density in response to variations of humidity detected by said humidity detecting means, while maintaining a relationship between values of the corrected reference toner density and humidity.

7. The image forming apparatus according to claim 6, wherein said relationship between values of the corrected reference toner density and humidity forms an S-shaped line.

8. The image forming apparatus according to claim 1, wherein said selected toner-humidity correction table is user selected.

9. The image forming apparatus according to claim 1, wherein, when humidity is relatively low, said reference density adjusting means changes a value of said predetermined reference toner density with a variation larger than a variation with which said predetermined reference toner density would normally be set.

10. An image forming apparatus, comprising:

an image developer for developing an image based on an electrostatic latent image formed on an image bearing surface;

a toner supplier for supplying toner to said image developer;

a toner density detector for detecting toner density inside said image developing means;

a humidity detector for detecting toner humidity, said humidity detector being located at a position where said humidity detector can detect humidity of air around said image developer and where said humidity detector is minimally affected by heated air;

a controller for controlling said toner supplier on the basis of toner density detected by said toner density detector and for adjusting a degree of said toner density in accordance with variations of humidity detected by said humidity detector;

a toner density controller for making a comparison of output values of said toner density detector and a predetermined reference toner density value, and for controlling said toner supplier in accordance with a result of said comparison; and a reference density adjuster for changing a value of said predetermined reference toner density in accordance with variations of humidity detected by said humidity detector, wherein said reference density adjuster includes a plurality of toner-humidity correction tables, each table containing data representing appropriate toner density varied as humidity varies, for representing different characteristics in conjunction with toner density, uses a selected one of said plurality of toner-humidity correction tables in response to variations of humidity detected by said humidity detector and changes said predetermined reference toner density in accordance with said selected toner-humidity correction table in response to variations of humidity detected by said humidity detector.

11. The image forming apparatus according to claim 10, wherein said image developer, toner supplier, toner density detector, and humidity detector are located in an enclosure, and wherein said humidity detector detects humidity in said enclosure.

12. The image forming apparatus according to claim 10, wherein said humidity detector is located at a position which is inside of said image forming apparatus over said image developer and at an approximate center of said image developer relative to a longitudinal direction of said image developer.

13. The image forming apparatus according to claim 10, wherein said reference density adjuster changes said value of said predetermined reference toner density to an extent within a range in which a value of humidity and output values of said humidity detector have a relationship of an approximate linear form.

14. The image forming apparatus according to claim 10, wherein, when humidity is relatively high, said reference density adjuster changes said value of said predetermined reference toner density to a value higher than a value to which said predetermined reference toner density would normally be set.

15. The image forming apparatus according to claim 10, wherein said reference density adjuster changes a value of said predetermined reference toner density in response to variations of humidity detected by said humidity detector, with maintaining a relationship between values of the corrected reference toner density and humidity.

16. The image forming apparatus according to claim 15, wherein said relationship between values of the corrected reference toner density and humidity forms an S-shaped line.

17. The image forming apparatus according to claim 10, wherein said selected toner-humidity correction table is user selected.

18. The image forming apparatus according to claim 10, wherein, when humidity is relatively low, said reference density adjuster changes a value of said predetermined reference toner density with a variation larger than a variation with which said predetermined reference toner density would normally be set.

19. An image forming method, comprising the steps of:

developing an image with an image developer based on an electrostatic latent image formed on an image bearing surface;

supplying toner to said image developer from a toner supplier;

detecting toner density inside said image developer with a toner density detector;

detecting toner humidity with a humidity detector, said humidity detector being located at a position where said humidity detector can detect humidity of air around said image developer and where said humidity detector is minimally affected by heated air;

controlling said toner supplier with a controller on the basis of toner density detected by said toner density detector;

adjusting a degree of said toner density with said controller in accordance with variations of humidity detected by said humidity detector;

making a comparison of output values of said toner density detector and a predetermined reference toner density value with a toner density controller;

controlling said toner supplier in accordance with a result of said comparison with said toner density controller; and changing a value of said predetermined reference toner density with a reference density adjuster in accordance with variations of humidity detected by said humidity detector, wherein said reference density adjuster includes a plurality of toner-humidity correction tables, each table containing data representing appropriate toner density varied as humidity varies, for representing different characteristics in conjunction with toner density, uses a selected one of said plurality of toner-humidity correction tables in response to variations of humidity detected by said humidity detector and changes said predetermined reference toner density in accordance with said selected toner-humidity correction table in response to variations of humidity detected by said humidity detector.

20. The image forming method according to claim 19, wherein said image developer, toner supplier, toner density detector, and humidity detector are located in an enclosure, and wherein said humidity detector step detects humidity in said enclosure.

21. The image forming method according to claim 19, further comprising a step of providing said humidity detector at a position which is inside of said image forming apparatus over said image developer and at an approximate center of said image developer relative to a longitudinal direction of said image developer.

22. The image forming method according to claim 19, wherein said step of changing said value of said predetermined reference toner density includes a step of changing said value of said predetermined reference toner density to an extent within a range in which a value of humidity and output values of said humidity detector have a relationship of an approximate linear form.

23. The image forming method according to claim 19, wherein, when humidity is relatively high, said step of changing said value of said predetermined reference toner density includes a step of changing said value of said predetermined reference toner density to a value higher than a value to which said predetermined reference toner density would normally be set.

24. The image forming method according to claim 19, wherein said step of changing said value of said predetermined reference toner density includes a step of changing a value of said predetermined reference toner density in response to variations of humidity detected by said humidity detector, with maintaining a relationship between values of the corrected reference toner density and humidity.

25. The image forming method according to claim 24, wherein said relationship between values of the corrected reference toner density and humidity forms an S-shaped line.

26. The image forming method according to claim 19, wherein said selected toner-humidity correction table is user selected.

27. The image forming method according to claim 19, wherein, when humidity is relatively low, said step of changing said value of said predetermined reference toner density includes a step of changing a value of said predetermined reference toner density with a variation larger than a variation with which said predetermined reference toner density would normally be set.

* * * * *